US010240509B2

(12) United States Patent
Nishi et al.

(10) Patent No.: US 10,240,509 B2
(45) Date of Patent: Mar. 26, 2019

(54) ENGINE

(71) Applicant: YAMAHA MOTOR POWER PRODUCTS KABUSHIKI KAISHA, Kakegawa-shi, Shizuoka (JP)

(72) Inventors: Kengo Nishi, Shizuoka (JP); Nobuo Jinnohara, Shizuoka (JP); Shinya Tsuda, Shizuoka (JP)

(73) Assignee: YAMAHA MOTOR POWER PRODUCTS KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/306,141

(22) PCT Filed: Apr. 24, 2015

(86) PCT No.: PCT/JP2015/062619

§ 371 (c)(1),
(2) Date: Oct. 24, 2016

(87) PCT Pub. No.: WO2015/163476

PCT Pub. Date: Oct. 29, 2015

(65) Prior Publication Data

US 2017/0045015 A1 Feb. 16, 2017

(30) Foreign Application Priority Data

Apr. 25, 2014 (JP) ..... 2014-091966

(51) Int. Cl.
*F02P 1/02* (2006.01)
*F01P 1/02* (2006.01)
(Continued)

(52) U.S. Cl.
CPC ..... *F01P 1/02* (2013.01); *F01P 1/06* (2013.01); *F01P 5/02* (2013.01); *F01P 5/06* (2013.01);
(Continued)

(58) Field of Classification Search
CPC ..... F01P 1/02; F01P 1/06; F01P 2001/023; F01P 1/026; F01P 5/02; F01P 5/06; F02F 1/04; F02F 1/06; F02F 7/00; F02F 7/007
See application file for complete search history.

(56) References Cited

U.S. PATENT DOCUMENTS 5,813,384 A 9/1998 Lavender et al.
9,500,117 B2 * 11/2016 Sullivan ..... F01P 5/02
(Continued)

FOREIGN PATENT DOCUMENTS

CN 1096849 A 12/1994
CN 1820139 A 8/2006
(Continued)

OTHER PUBLICATIONS

Sullivan, U.S. Appl. No. 61/777,917, filed Mar. 12, 2013.*
Official Communication issued in International Patent Application No. PCT/JP2015/062619, dated Jul. 14, 2015.

*Primary Examiner* — Hung Q Nguyen
*Assistant Examiner* — Mark L. Greene
(74) *Attorney, Agent, or Firm* — Keating and Bennett, LLP

(57) ABSTRACT

An engine includes a crankcase with cylinders and fins on outer circumferences of the cylinders. A crank shaft penetrates the crankcase. A cooling fan is provided on an outer side of the crankcase and arranged coaxially with the crank shaft. A first cover covers an outer side of the cylinders and the crankcase, and the cooling fan. A second cover capable of being detached from/attached to the first cover. The first cover includes a first opening facing the cooling fan, and second openings facing the fins. The second cover includes an air inlet facing the first opening, and attached to the first cover to cover the first opening and the second openings.

4 Claims, 14 Drawing Sheets

(51) Int. Cl.

| | |
|---|---|
| ***F01P 5/06*** | (2006.01) |
| ***F01P 1/06*** | (2006.01) |
| ***F01P 5/02*** | (2006.01) |
| ***F02F 1/06*** | (2006.01) |
| ***F02F 7/00*** | (2006.01) |

(52) U.S. Cl.
CPC ..... *F02F 1/06* (2013.01); *F02F 7/007* (2013.01); *F01P 2001/023* (2013.01); *F01P 2001/026* (2013.01)

(56) References Cited

U.S. PATENT DOCUMENTS

| | | | | |
|---|---|---|---|---|
| 2004/0025827 | A1 | 2/2004 | Davis | |
| 2004/0154559 | A1 | 8/2004 | Geisheker et al. | |
| 2014/0261259 | A1* | 9/2014 | Sullivan | F01P 5/02 123/41.65 |
| 2017/0058825 | A1* | 3/2017 | Sullivan | F01P 5/02 |
| 2017/0159600 | A1* | 6/2017 | Cook | F02F 1/065 |

FOREIGN PATENT DOCUMENTS

| | | | |
|---|---|---|---|
| EP | 0 604 937 | A1 | 12/1993 |
| JP | 47-2981 | Y1 | 2/1972 |
| JP | 55-130050 | U | 9/1980 |
| JP | 6-200757 | A | 7/1994 |
| JP | 10-169445 | A | 6/1998 |
| JP | 2000-213366 | A | 8/2000 |
| JP | 2001-241325 | A | 9/2001 |
| JP | 2006-514224 | A | 4/2006 |
| JP | 2008-133747 | A | 6/2008 |
| JP | 2008-157222 | A | 7/2008 |

* cited by examiner

ENGINE

BACKGROUND OF THE INVENTION

1. Field of the Invention

The present invention relates to engines, and more specifically to an engine used in machinery such as mowing equipment.

2. Description of the Related Art

JP-A H10-169445 discloses an example of an engine of the above type. JP-A H10-169445 discloses an air-cooled engine wherein an engine main body supports a crank shaft, at an end of which, a cooling fan is attached. An air inlet faces a front surface of the cooling fan, and in order to introduce cooling air sucked from the air inlet to a cylinder block of the engine main body, there is provided a shroud which covers a side of the engine main body, and a screen grid which covers the air inlet and is fixed to the cooling fan.

The engine disclosed in JP-A H10-169445 requires time-consuming removal of the shroud itself at times of maintenance activities such as cleaning the vicinity of fins which are provided on an outer circumference of the cylinder block, for example. Especially, if a fuel pump is located near the shroud, the fuel pump must also be removed, which means that a longer time is required. The engine according to JP-A H10-169445 has poor efficiency with respect to maintenance activities.

SUMMARY OF THE INVENTION

Preferred embodiments of the present invention provide an engine which is able to improve maintenance efficiency.

According to a preferred embodiment of the present invention, an engine includes a crankcase; a cylinder provided in the crankcase and including fins on an outer circumference thereof; a crank shaft provided inside the crankcase and penetrating the crankcase; a cooling fan provided on an outer side of the crankcase and arranged coaxially with the crank shaft to introduce cooling air from the outer side of the crankcase; a first cover that covers an outer side of the cylinder and the crankcase, and the cooling fan; and a second cover capable of being attached to and detached from the first cover. With the above arrangement, the first cover includes a first opening located at a position to face the cooling fan and a second opening located at a position to face the fins, and the second cover includes an air inlet located at a position to face the first opening, and is attached to the first cover to cover the first opening and the second opening.

According to a preferred embodiment of the present invention, by only removing the second cover, it is possible to use the first opening and the second opening in the first cover to remove debris such as turf grass and other plants easily from areas of the cooling fan and the fins of the cylinder, thus improving the efficiency of performing maintenance.

Preferably, the first cover further includes a wall between the first opening and the second opening. In this case, the wall decreases chances for debris such as turf grass and other plants to enter from the air inlet into the second opening.

Further preferably, the wall is located at an edge region of the second opening. In this case, the wall further decrease chances for debris such as turf grass and other plants to enter from the air inlet into the second opening.

Further, preferably, the second cover is attached to the first cover to define an outlet for the cooling air adjacent the wall between the first cover and the second cover. In this case, even if debris such as turf grass and other plants enter from the air inlet to between the first cover and the second cover, it is possible to remove the debris out of the outlet along the wall.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 7:
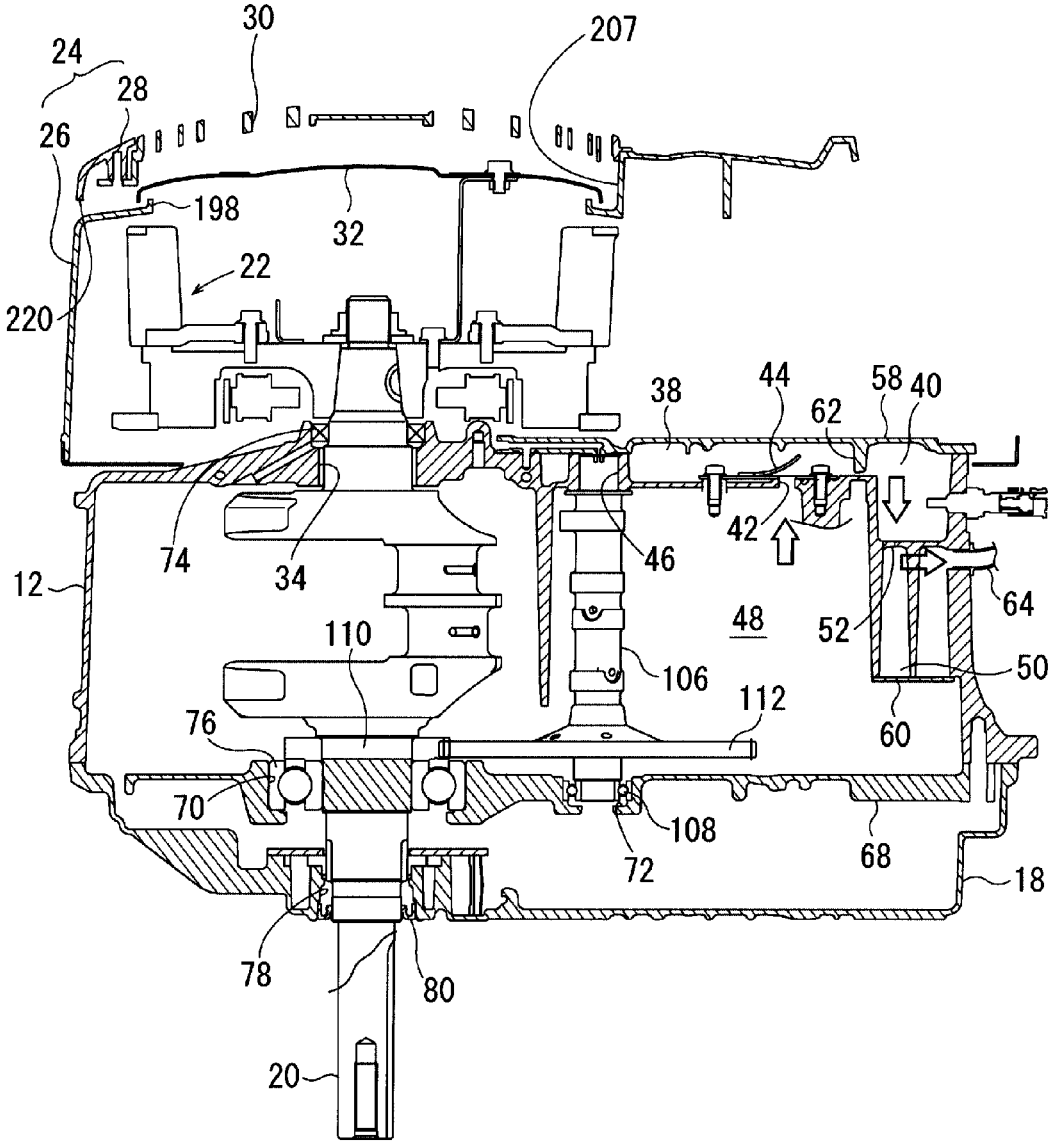
FIG. 7 is a vertical (taken along line A-A in FIG. 8) sectional view of the engine according to a preferred embodiment of the present invention.

Referring to FIG. 1 through FIG. 6, an engine 10 according to a preferred embodiment of the present invention is, for example, a vertical, narrow-angle (less than 90 degrees), V-shaped, two-cylinder, OHV engine (Over Head Valve Engine). The engine 10 includes a crankcase 12. Two cylinders 14, 16 are arranged in a V-shape on a side surface of the crankcase 12. An oil pan 18 is provided below the crankcase 12. A crank shaft 20 is arranged inside the crankcase 12 and the oil pan 18 so that its axial direction extends in an up-down direction (see FIG. 7). The crank shaft 20 penetrates the crankcase 12 and the oil pan 18 in the up-down direction. Referring to FIG. 7, above the crankcase 12, a cooling fan 22 is arranged coaxially with the crank shaft 20. The cooling fan 22 is driven by the crank shaft 20, and introduces cooling air from above the crankcase 12. A cover portion 24 covers the cylinders 14, 16, the crankcase 12, and the cooling fan 22 from above. The cover portion 24 includes a first cover 26 and a second cover 28 which is attached onto the first cover 26. The second cover 28 includes an air inlet 30 at a location facing the cooling fan 22 to introduce air from the outside. Inside the second cover 28, there is provided a grass screen 32 which has a mesh structure. Therefore, even if impurities such as grass happen to pass through the air inlet 30, they are caught by the grass screen 32 and their entry to the cooling fan 22 is significantly reduced or prevented. Therefore, it is possible to take outside air via the second cover 28 and the grass screen 32 into the first cover 26. The outside air introduced from the air inlet 30 by driving the cooling fan 22 cools the engine 10. The first cover 26 and the second cover 28 will be described below.

Figure 8:
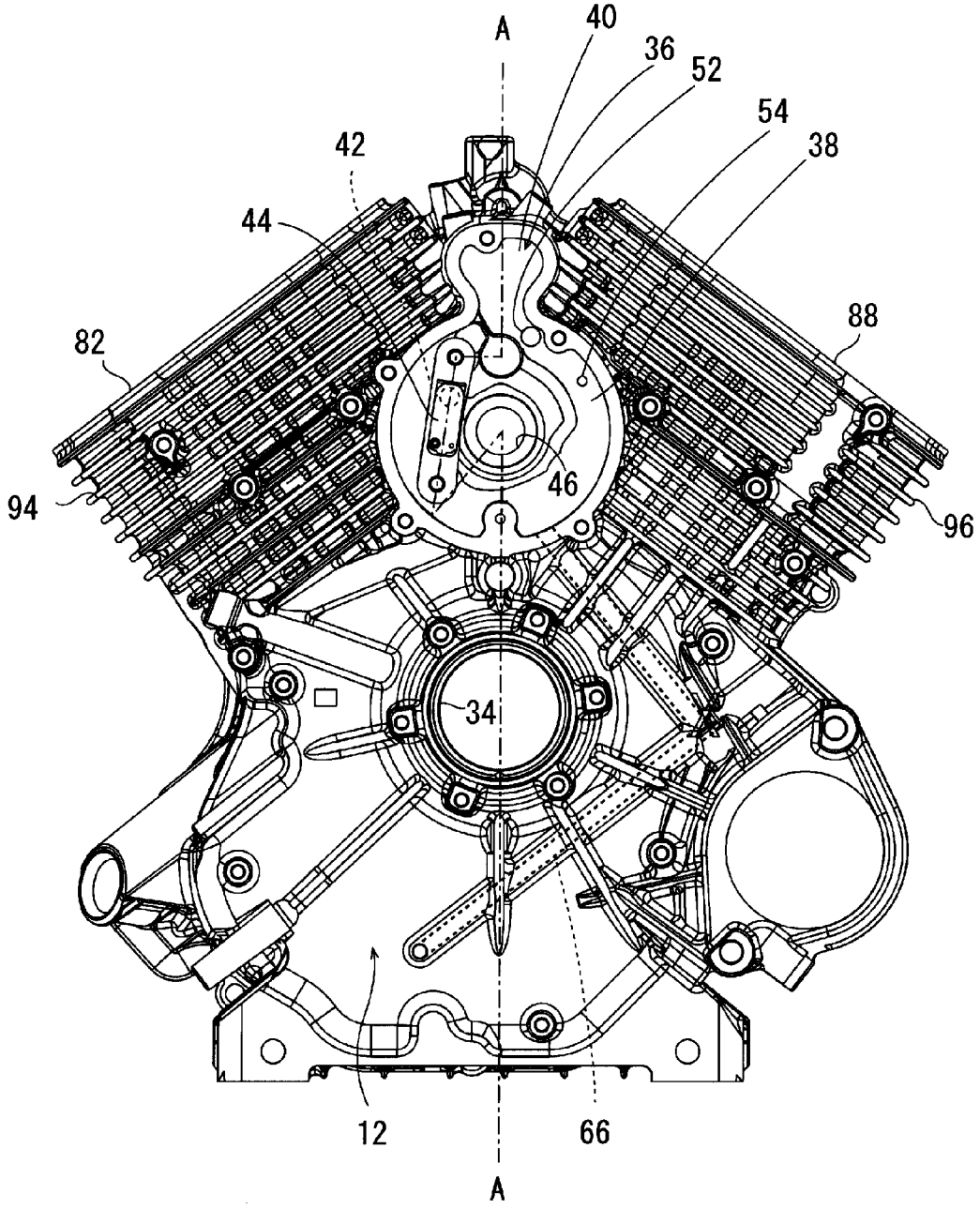
FIG. 8 is a plan view showing a crankcase and a cylinder body.
Figure 9:
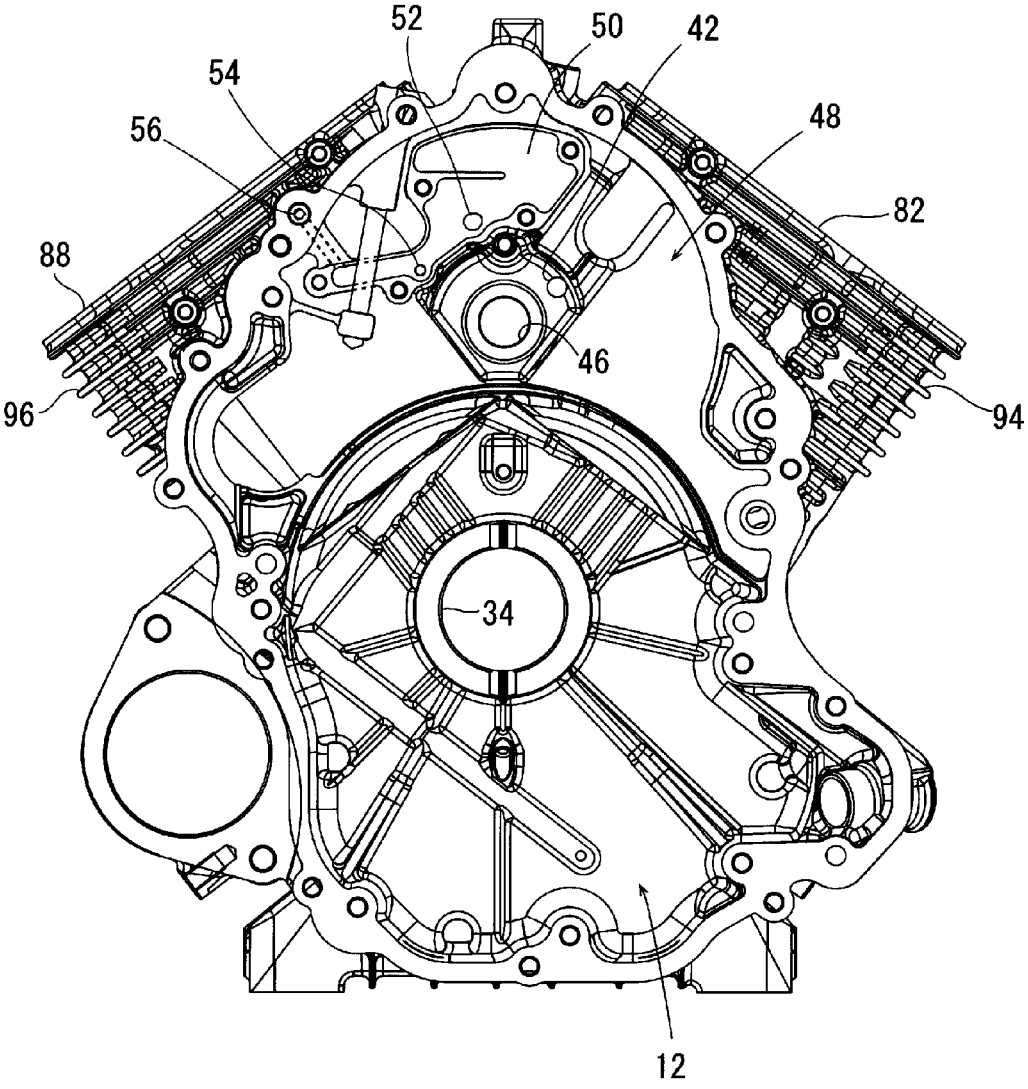
FIG. 9 is a bottom view showing the crankcase and the cylinder body.
Figure 10:
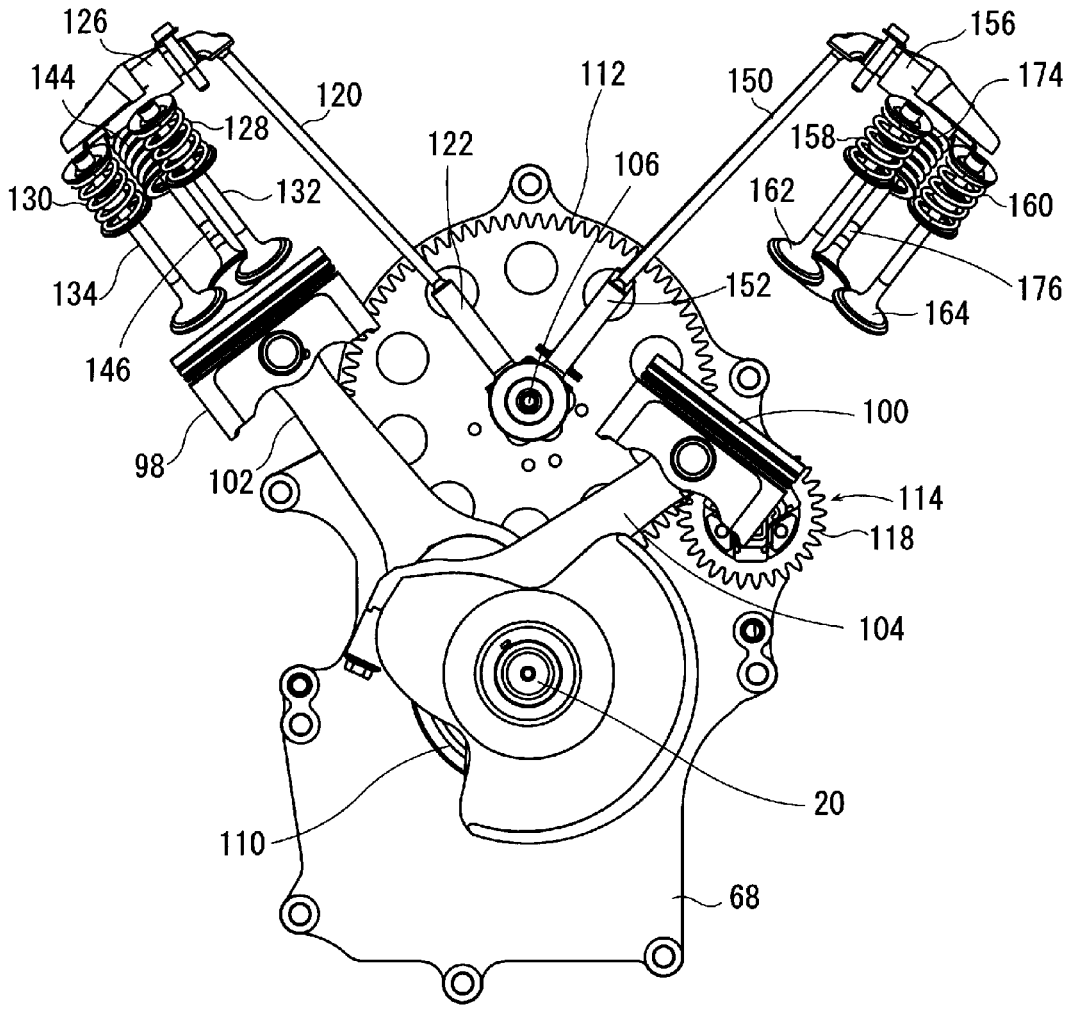
FIG. 10 is a plan view showing a crank shaft, pistons and their surroundings.
Figure 11:
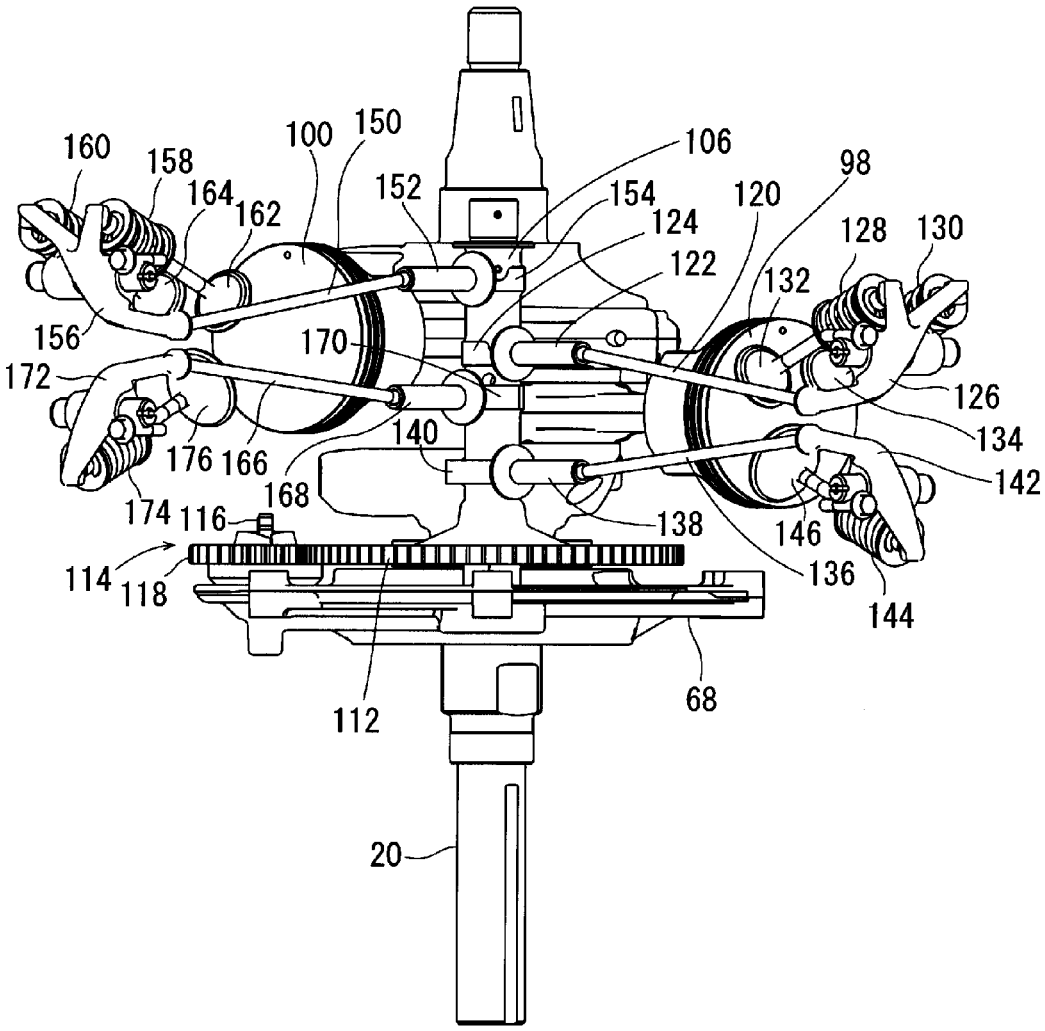
FIG. 11 is a view showing the crank shaft, the pistons and their surroundings.
Figure 12:
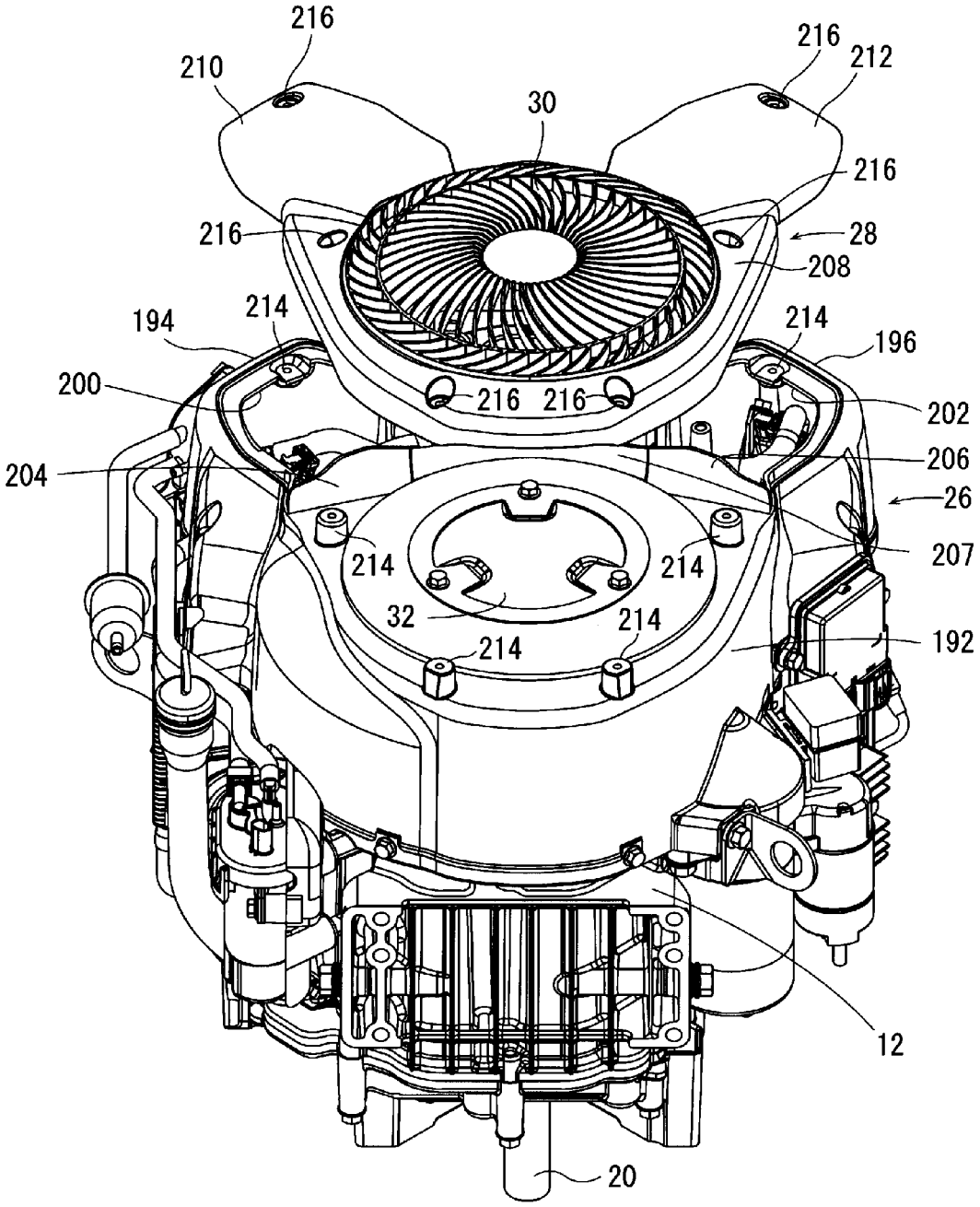
FIG. 12 is an exploded perspective view (from a crankcase side) showing the engine in a state where a second cover is separated from a first cover.
Figure 13:
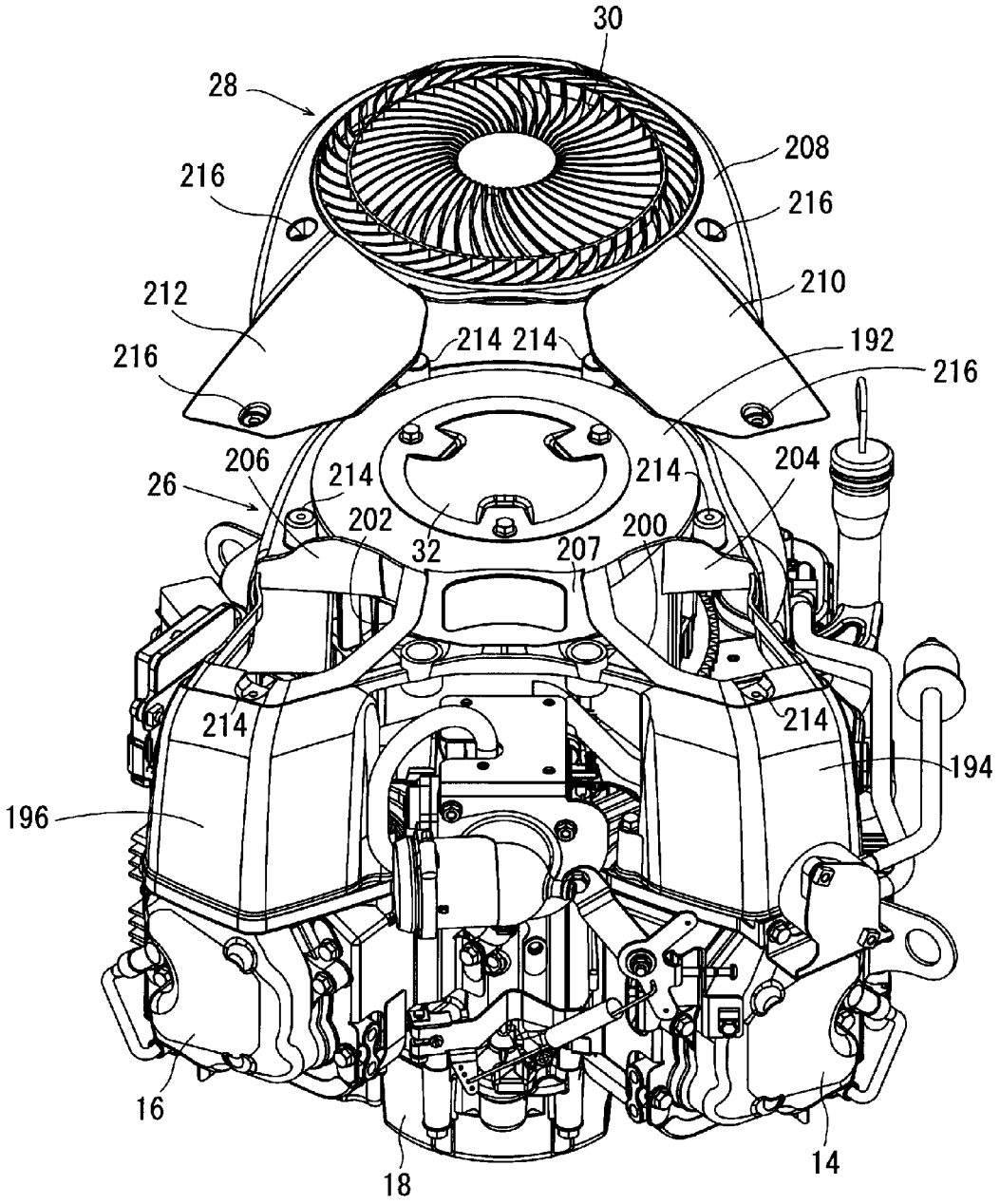
FIG. 13 is an exploded perspective view (from a cylinder side) showing the engine in a state where the second cover is separated from the first cover.

Referring to FIG. 7 through FIG. 9, the crankcase 12 includes a through-hole 34 that is penetrated by the crank shaft 20. The crankcase 12 includes an upper surface including an upward opening and a generally gourd-shaped recess 36. In the recess 36, there are provided a first gas/liquid separating chamber 38 and a second gas/liquid separating chamber 40. The first gas/liquid separating chamber 38 and a hollow portion 48 (which will be described below) of the crankcase 12 communicate with each other via a through-hole 42. The through-hole 42 is opened/closed by a reed valve 44 provided in the first gas/liquid separating chamber 38. In a generally center region of the first gas/liquid separating chamber 38, there is provided a bearing hole 46 that receives a cam shaft 106 (which will be described below). In the crankcase 12, the hollow portion 48 includes a downward opening. The hollow portion 48 defines an oil chamber. In the hollow portion 48, a third gas/liquid separating chamber 50 is provided. The second gas/liquid separating chamber 40 and the third gas/liquid separating chamber 50 communicate with each other via an oil return hole 52; the first gas/liquid separating chamber 38 and the third gas/liquid separating chamber 50 communicate with each other via an oil return hole 54; and the third gas/liquid separating chamber 50 and the oil pan 18 communicate with each other via an oil return channel 56 provided in the crankcase 12 and an oil return channel (not illustrated) provided in the oil pan 18. The first gas/liquid separating chamber 38 and the second gas/liquid separating chamber 40 have their upper surfaces provided with a lid 58. The third gas/liquid separating chamber 50 includes a lid 60 on its lower surface. The lid 58 includes a lower surface including a wall 62, which reduces gas flow from the first gas/liquid separating chamber 38 to the second gas/liquid separating chamber 40. Blowby gas from the hollow portion 48 of the crankcase 12 is separated into gas and liquid in the first gas/liquid separating chamber 38 and the second gas/liquid separating chamber 40, and further in the third gas/liquid separating chamber 50. As indicated by white arrows in FIG. 7, blowby gas is sent from the hollow portion 48, through the first gas/liquid separating chamber 38, the second gas/liquid separating chamber 40, the third gas/liquid separating chamber 50, a gas tube 64, etc., to an upstream location in an air intake system. Lubricant oil separated in the first gas/liquid separating chamber 38, the second gas/liquid separating chamber 40 and the third gas/liquid separating chamber 50 is returned from the third gas/liquid separating chamber 50, through the oil return channel 56 and so on, to the oil pan 18.

Referring to FIG. 8, if the engine 10 is mounted horizontally, lubricant oil from the first gas/liquid separating chamber 38 is returned to the oil pan 18 via a generally V-shaped oil return channel 66. As described, depending on whether the engine 10 is mounted vertically or horizontally, a different oil return channel is used to return lubricant oil to the oil pan 18.

Referring to FIG. 7, the support member 68 includes a through-hole 70 that receives the crank shaft 20, a through-hole 72 that receives a cam shaft 106 (which will be described below), and a through-hole (not illustrated) that receives a governor shaft 116 (which will be described below). The support member 68 is attached to the crankcase 12 with unillustrated fasteners such as bolts, for example. The support member 68 has dimensions to define a gap between an outer circumference of the support member 68 and an end edge of the crankcase 12, and a gap between the outer circumference of the support member 68 and an end edge of the oil pan 18. This allows communication between the crankcase 12 and the oil pan 18. With the above arrangement, an upper region of the crank shaft 20 is supported by the crankcase 12 via a bearing 74 provided in the through-hole 34 whereas a lower region of the crank shaft 20 is supported by the support member 68 via a ball bearing 76 provided in the through-hole 70. In this arrangement, the crank shaft 20 penetrates the crankcase 12 and the support member 68 in an up-down direction; the support member 68 supports one side of the crank shaft 20 pivotably; and the crankcase 12 supports another side of the crank shaft 20 pivotably. The crankcase 12 and the oil pan 18 are fixed to each other with unillustrated fasteners. The upper surface opening oil pan 18 includes a through-hole 78 to be penetrated by the crank shaft 20. An oil seal 80 is placed between the crank shaft 20 and the through-hole 78. The oil pan 18 stores lubricant oil to supply to various portions or elements of the engine 10.

Returning to FIG. 2 and FIG. 4, the cylinder 14 includes a cylinder body 82, a cylinder head 84 and a cylinder head cover 86. The cylinder 16 includes a cylinder body 88, a cylinder head 90 and a cylinder head cover 92. Referring to FIG. 8 and FIG. 9, the cylinder bodies 82, 88 are preferably formed integrally with the crankcase 12. Each of the cylinder bodies 82, 88 includes fins 94, 96 on its outer circumference.

Referring to FIG. 8 through FIG. 11, pistons 98, 100 are provided slidably inside the cylinder bodies 82, 88 respectively. Each of the pistons 98, 100 is connected by a corresponding one of connecting rods 102, 104 to the crank shaft 20 inside the crankcase 12. Reciprocating movement of the pistons 98, 100 is converted into rotating movement by the crank shaft 20. The crankcase 12 incorporates the cam shaft 106 which moves together with the crank shaft 20. Referring to FIG. 7, the cam shaft 106 includes an end region supported pivotably in the bearing hole 46 by the crankcase 12 via a film of oil. The cam shaft 106 has the other end region supported pivotably by the support member 68 via a ball bearing 108 placed in the through-hole 72. The crank shaft 20 is provided with a driving gear 110, whereas the cam shaft 106 is provided with a driven gear 112 which rotates as the driving gear 110 rotates. Also, a governor 114 is provided inside the crankcase 12. The governor 114 is a structure or system that maintains the number of rotations of the engine 10 within a predetermined range even if there is load fluctuation. The governor 114 includes the governor shaft 116, which is pressed into an unillustrated through-hole of the support member 68. The governor 114 includes a governor gear 118, which is attached pivotably to the governor shaft 116, engaged with the driven gear 112, and is rotated as the driven gear 112 rotates. The crank shaft 20, the cam shaft 106 and the governor shaft 116 which are supported by the support member 68 are disposed in parallel (or substantially in parallel) to each other.

In the respective cylinders 14, 16, from the cylinder bodies 82, 88 to the cylinder heads 84, 90, communication paths (not illustrated) are provided for communication between the inside of the crankcase 12 and rocker arm chambers (not illustrated) inside the cylinder head covers 86, 92.

In the cylinder 14, a push rod 120 and a tappet 122 provided at an end region of the push rod 120 are inserted into the communication path. The tappet 122 includes a tip portion in contact with an air intake cam 124 of the cam shaft 106 inside the crankcase 12. The push rod 120 includes another end region connected to a rocker arm 126 provided inside the rocker arm chamber. Air intake valves 132, 134, which are constantly urged by valve springs 128, 130 in a closing direction, are driven by the rocker arm 126. The air intake valves 132, 134 open/close two air intake ports (not illustrated). Also, a push rod 136 and a tappet 138 provided at an end region of the push rod 136 are inserted into the communication path. The tappet 138 includes a tip portion in contact with an exhaust cam 140 of the cam shaft 106 inside the crankcase 12. The push rod 136 includes another end region connected to a rocker arm 142 provided inside the rocker arm chamber. An exhaust valve 146, which is constantly urged by a valve spring 144 in a closing direction, is driven by the rocker arm 142. The exhaust valve 146 opens/closes an exhaust port 148 (see FIG. 4).

Likewise, in the cylinder 16, a push rod 150 and a tappet 152 provided at an end region of the push rod 150 are inserted into the communication path. The tappet 152 includes a tip portion in contact with an air intake cam 154 of the cam shaft 106 inside the crankcase 12. The push rod 150 includes another end region connected to a rocker arm 156 provided inside the rocker arm chamber. Air intake valves 162, 164, which are constantly urged by valve springs 158, 160 in a closing direction, are driven by the rocker arm 156. The air intake valves 162, 164 open/close two air intake ports (not illustrated). Also, a push rod 166 and a tappet 168 provided at an end region of the push rod 166 are inserted into the communication path. The tappet 168 includes a tip portion in contact with an exhaust cam 170 of the cam shaft 106 inside the crankcase 12. The push rod 166 includes another end region connected to a rocker arm 172 provided inside the rocker arm chamber. An exhaust valve 176, which is constantly urged by a valve spring 174 in a closing direction, is driven by the rocker arm 172. The exhaust valve 176 opens/closes an exhaust port 178 (see FIG. 4).

Figure 1:
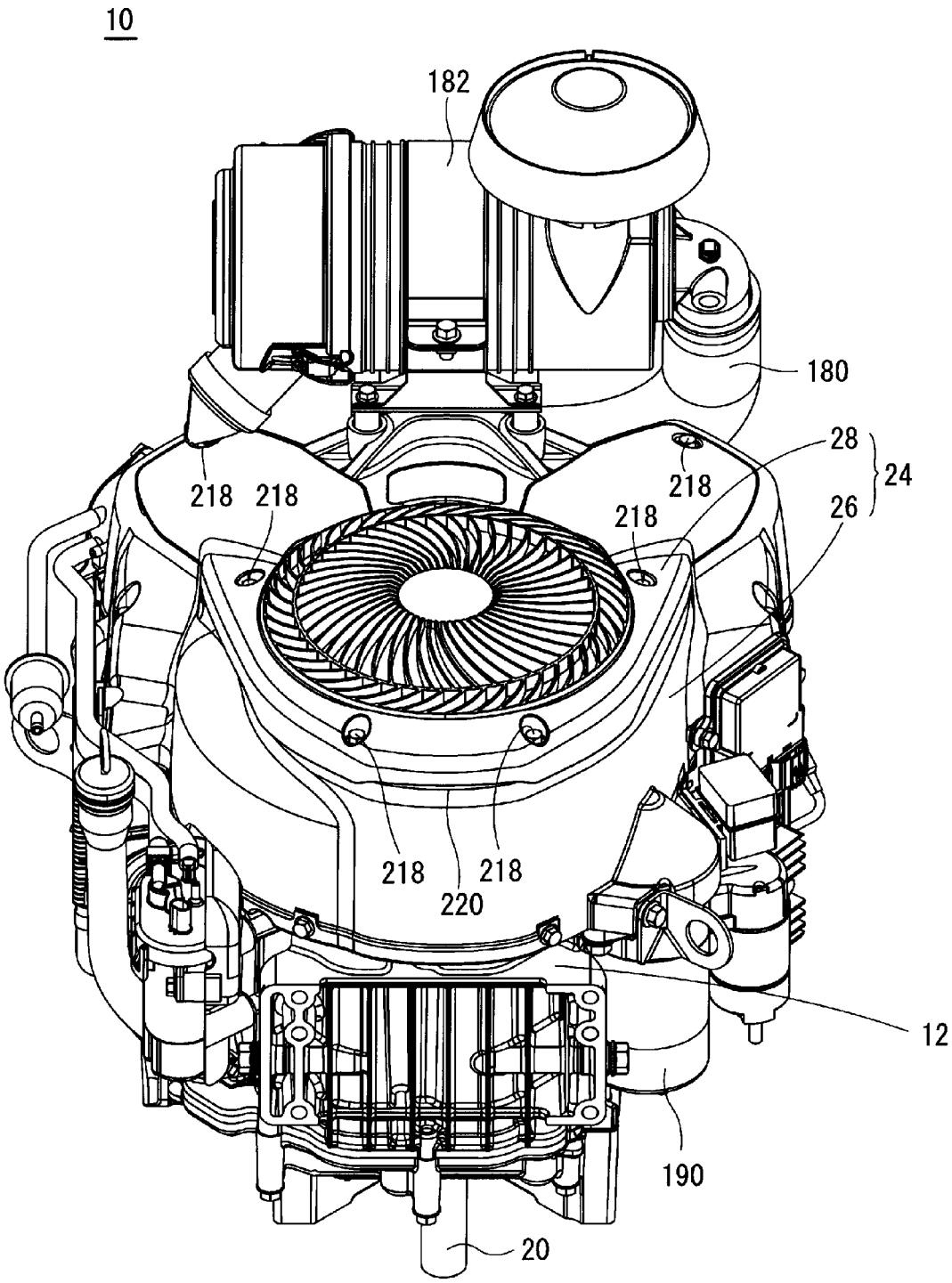
FIG. 1 is a top perspective view of an engine according to a preferred embodiment of the present invention.
Figure 2:
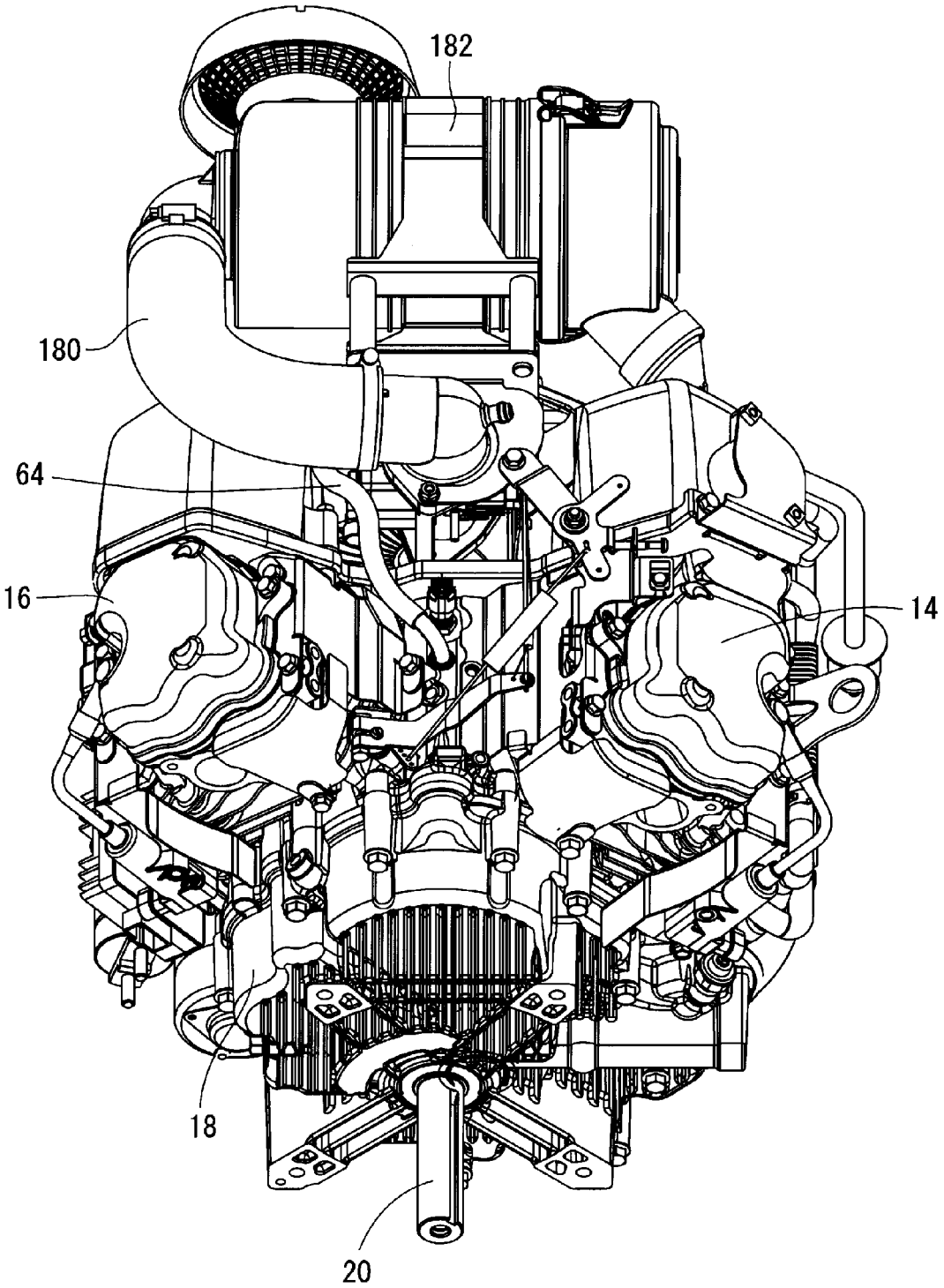
FIG. 2 is a bottom perspective view of the engine according to a preferred embodiment of the present invention.
Figure 3:
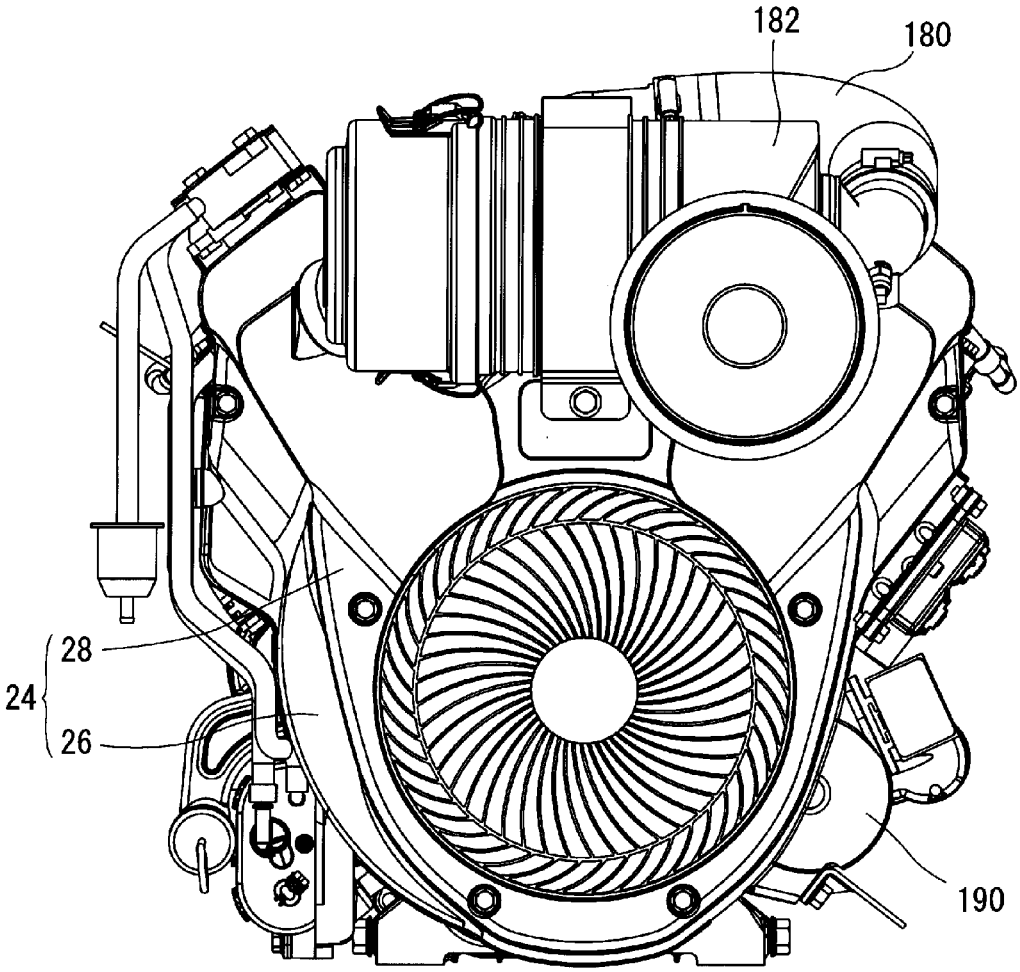
FIG. 3 is a plan view of the engine according to a preferred embodiment of the present invention.
Figure 4:
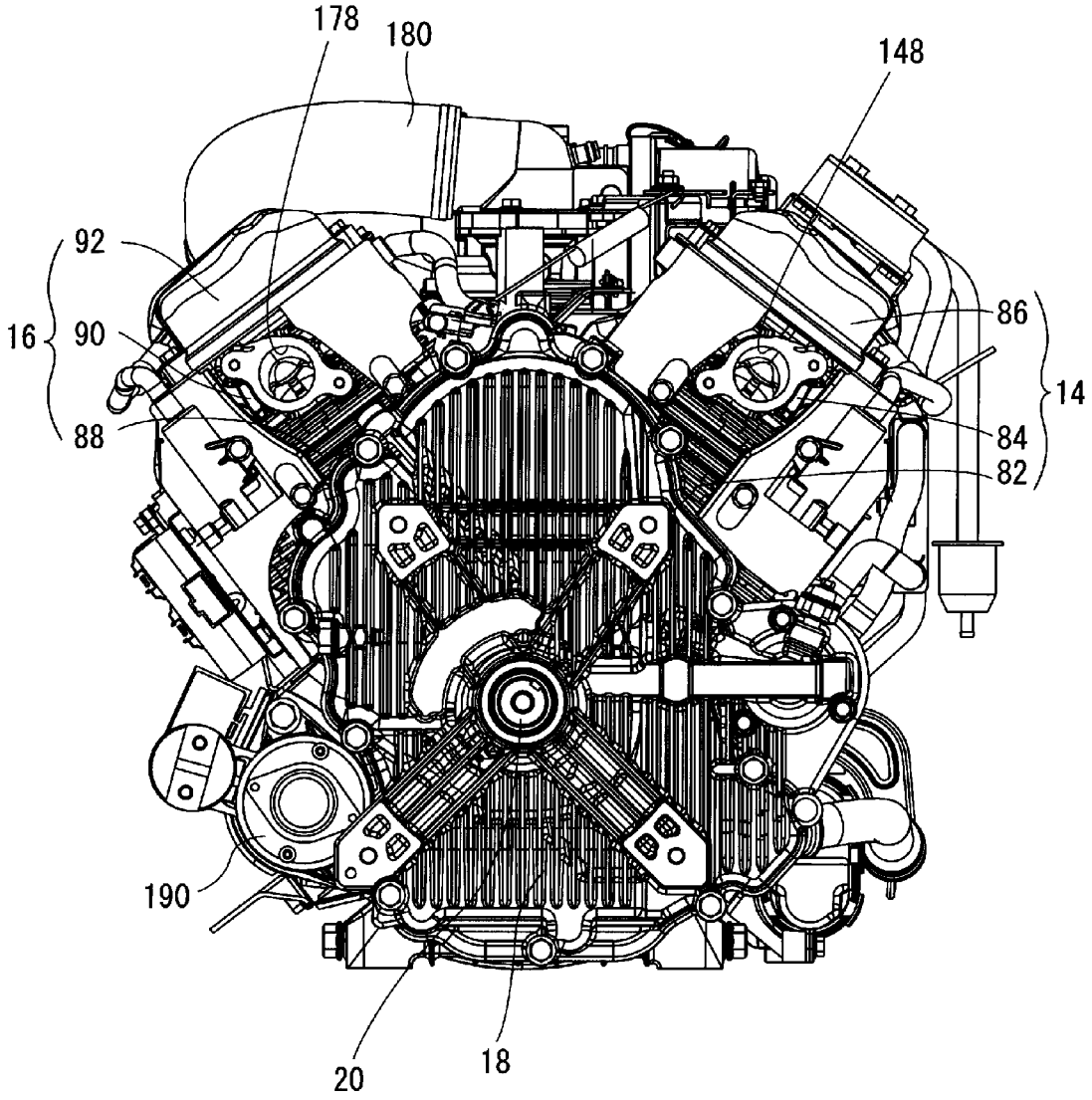
FIG. 4 is a bottom view of the engine according to a preferred embodiment of the present invention.
Figure 5:
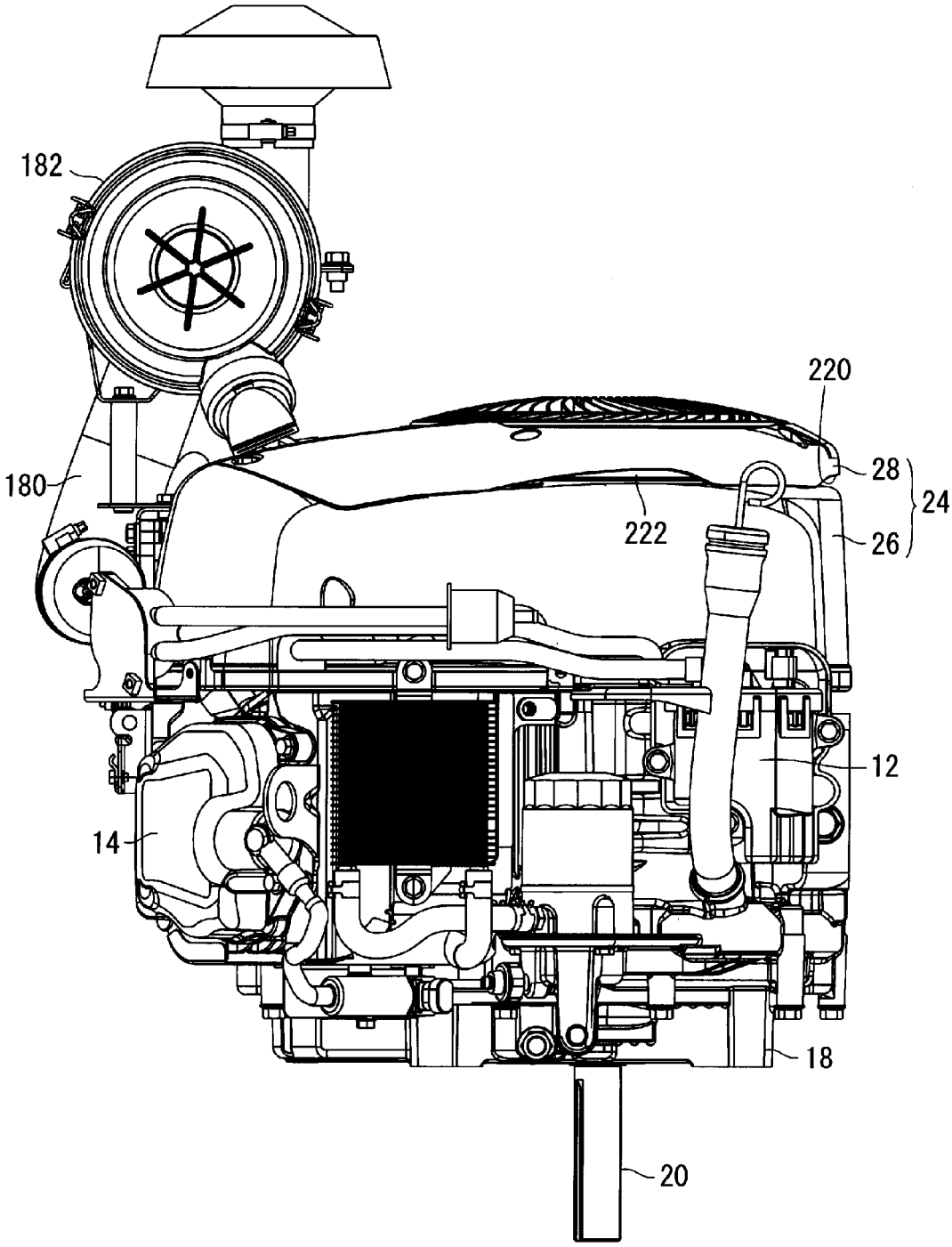
FIG. 5 is a side view (taken from the left) of the engine according to a preferred embodiment of the present invention.
Figure 6:
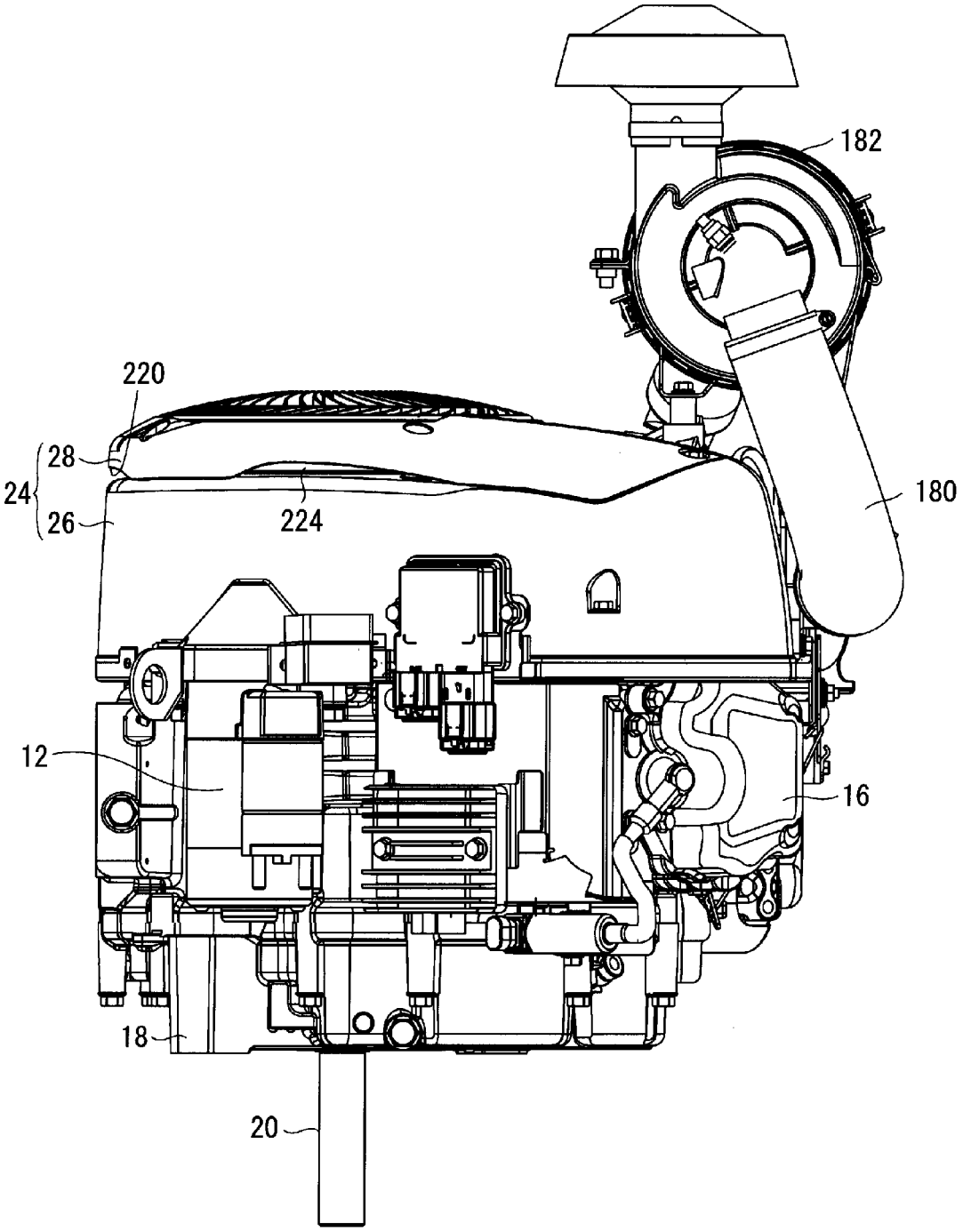
FIG. 6 is a side view (taken from the right) of the engine according to a preferred embodiment of the present invention.
Figure 14B:
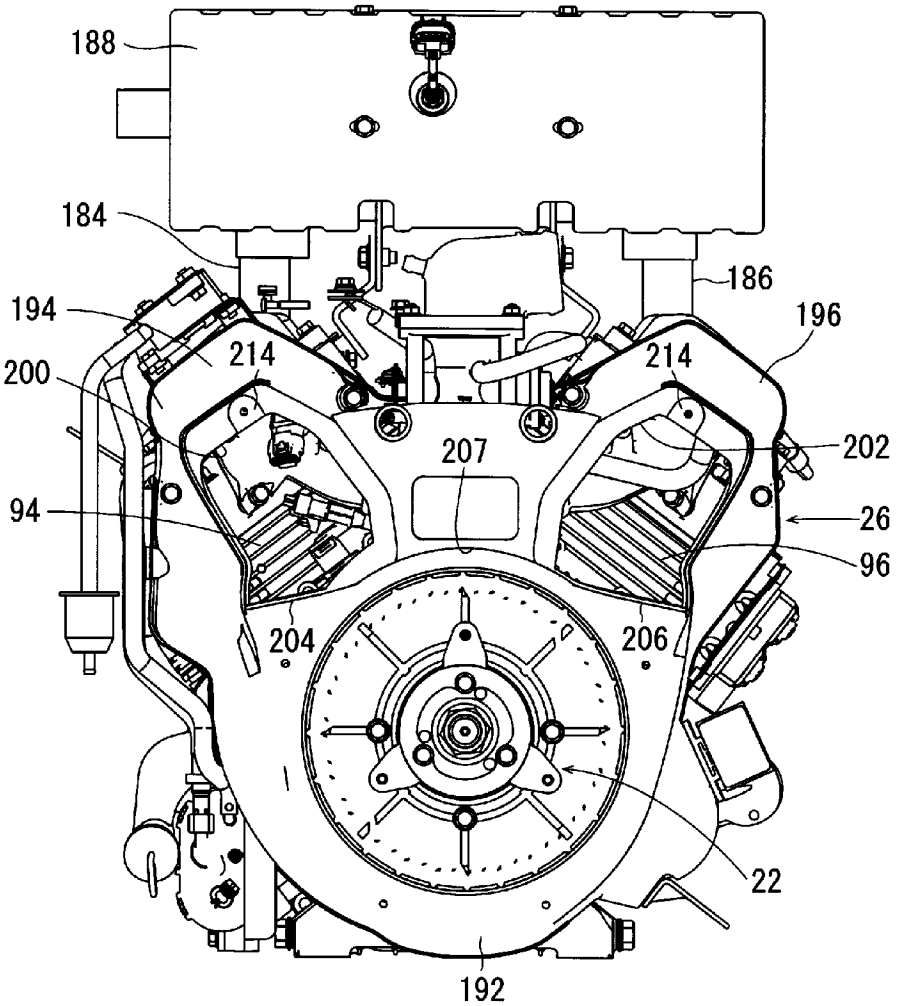
FIG. 14B is a plan view showing the engine with the second cover removed.
Figure 14A:
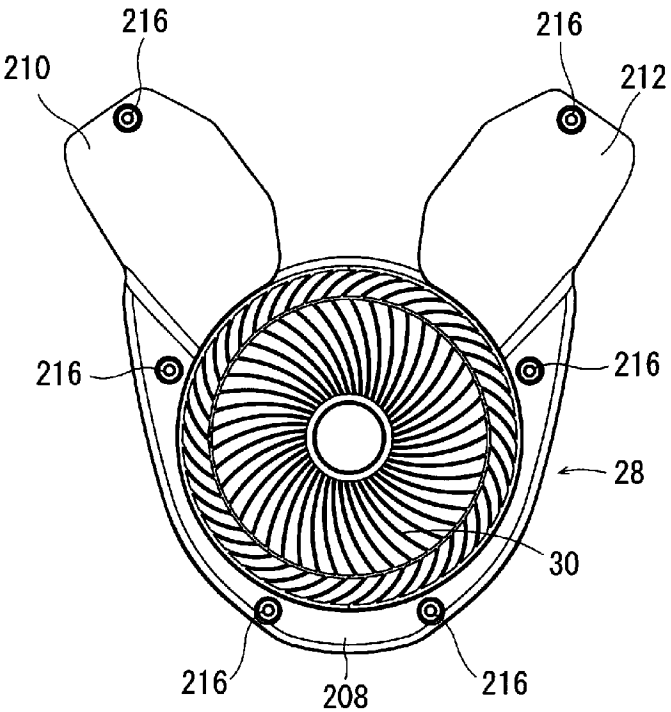
FIG. 14A is a plan view showing the second cover.

It should be noted here that an air filter 182 is preferably attached to each air intake port of the cylinders 14, 16 via an air intake pipe 180 and so on (see FIG. 1, FIG. 2). A muffler 188 is connected to the exhaust ports 148, 178 of the cylinders 14, 16 via respective exhaust pipes 184, 186 (see FIGS. 14A and 14B). Exhaust gas from the engine 10 is discharged outside via the muffler 188. The engine 10 is supplied with fuel from an unillustrated fuel tank. A starter motor 190 rotates the crank shaft 20 to start the engine 10.

Referring to FIG. 7, and FIGS. 12 through 14, the first cover 26 and the second cover 28 will be described.

The first cover 26 includes a downward opening, and includes a first main body portion 192 which covers mainly an outer side of the crankcase 12, and first protruding portions 194, 196 which cover mainly an outer side of the cylinders 14, 16. The first main body portion 192 and the first protruding portions 194, 196 are preferably integral with each other. The first main body portion 192 includes a generally circular first opening 198 (see FIG. 7) located at a position to face the cooling fan 22. The first protruding portion 194 includes a second opening 200 located at a position to face the fins 94. The first protruding portion 196 includes a second opening 202 located at a position to face the fins 96. The first opening 198 is provided with the grass screen 32.

The first cover 26 further includes a wall 204 located between the first opening 198 and the second opening 200, and a wall 206 located between the first opening 198 and the second opening 202. The wall 204 is preferably located on an edge region of the second opening 200, whereas the wall 206 is preferably located on an edge region of the second opening 202. The first cover 26 further includes a wall 207 located between the wall 204 and the wall 206. The wall 207 is disposed along an edge region of the first opening 198, connecting an end portion of the wall 204 and an end portion of the wall 206 to each other. Therefore, the wall 204, the wall 206 and the wall 207 are continuous along the first opening 198.

The second cover 28 includes a plate-shaped second main body portion 208 that covers the first opening 198 of the first cover 26, and plate-shaped second protruding portions 210, 212 that cover the second openings 200, 202 of the first cover 26. The second main body portion 208 and the second protruding portions 210, 212 are preferably integral with each other. The air inlet 30 is positioned in the second main body portion 208 to face the first opening 198. The second cover 28 is attached to the first cover 26 so that the second protruding portions 210, 212 cover the second openings 200, 202 and the second main body portion 208 covers the first opening 198.

The first cover 26 includes a plurality (for example, six in the present preferred embodiment) of mounts 214, whereas the second cover 28 includes a plurality (for example, six in the present preferred embodiment) of mounts 216. Each mount 214 in the first cover 26 is fixed to a corresponding one of the mounts 216 in the second cover 28 with fasteners 218 such as bolts (see FIG. 1), such that the second cover 28 is attached to the first cover 26. By attaching/removing the fasteners 218, the second cover 28 is able to be attached to/removed from the first cover 26.

Referring also to FIG. 1, and FIGS. 5 through 7, attaching the second cover 28 to the first cover 26 defines outlets 220, 222, 224 to provide cooling air in three ways between the first cover 26 and the second cover 28. In other words, along an outer circumference of the second cover 28, the outlet 220 is between the outlets 222 and 224, and in a plan view, the outlets 222 and 224 are at located at positions to sandwich the air inlet 30. The outlet 222 is adjacent or near the wall 204, whereas the outlet 224 is adjacent or near the wall 206. In the present preferred embodiment, the outlets 220, 222, 224 are defined by providing recesses in the second cover 28. However, the present invention is not limited to this. The outlets 220, 222, 224 may be provided by recesses in the first cover 26.

According to the engine 10, by only removing the second cover 28, it is possible to use, for example, compressed air to blow from the first opening 198 and the second openings 200, 202 in the first cover 26 debris such as turf grass and other plants easily from areas of the cooling fan 22 and fins 94, 96 of the cylinders 14, 16; therefore it is possible to improve the efficiency in performing maintenance activities.

Since the first cover 26 includes the walls 204, 206 between the first opening 198 and the second openings 200, 202, it is possible, with the walls 204, 206, to decrease the likelihood that debris such as turf grass and other plants enter from the air inlet 30 into the second openings 200, 202.

Since the walls 204, 206 are provided at edges of the second openings 200, 202, it is possible, with the walls 204, 206, to further decrease the likelihood that debris such as turf grass and other plants enter from the air inlet 30 into the second openings 200, 202.

The second cover 28 is attached to the first cover 26 in such a manner to define the outlets 222, 224 for the cooling air adjacent or near the walls 204, 206 between the first cover 26 and the second cover 28. Therefore, even if debris such as turf grass and other plants enter from the air inlet 30 to between the first cover 26 and the second cover 28, it is possible to remove the debris out of the outlets 222, 224 along the walls 204, 206.

It should be noted here that in the preferred embodiments of the present invention described above, description was made in which the preferred embodiments include a two-cylinder engine, for example. However, the present invention is not limited to this. The present invention is also applicable to a single-cylinder engine or an engine having three or more cylinders.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An engine comprising:

a crankcase;

a cylinder in the crankcase and including fins on an outer circumference thereof;

a crank shaft inside the crankcase and penetrating the crankcase;

a cooling fan on an outer side of the crankcase and coaxial with the crank shaft to introduce cooling air from the outer side of the crankcase;

a first cover that covers an outer side of the cylinder, the outer side of the crankcase, and the cooling fan; and a second cover capable of being attached to and detached from the first cover; wherein the first cover includes a first opening facing the cooling fan and a second opening facing the fins;

the second cover includes an air inlet facing the first opening and is attached to the first cover to cover the first opening and the second opening; and an inner surface of the second cover faces a portion of the fins without any intervening members.

2. The engine according to claim 1, wherein the first cover further includes a wall between the first opening and the second opening;

the first cover includes a main body; and the wall extends higher than the main body in an axial direction of the crank shaft.

3. An engine comprising:

a crankcase;

a cylinder in the crankcase and including fins on an outer circumference thereof;

a crank shaft inside the crankcase and penetrating the crankcase;

a cooling fan on an outer side of the crankcase and coaxial with the crank shaft to introduce cooling air from the outer side of the crankcase;

a first cover that covers an outer side of the cylinder, the outer side of the crankcase, and the cooling fan; and a second cover capable of being attached to and detached from the first cover; wherein the first cover includes a first opening facing the cooling fan and a second opening facing the fins;

the second cover includes an air inlet facing the first opening and is attached to the first cover to cover the first opening and the second opening;

the first cover further includes a wall between the first opening and the second opening;

the wall is located at an edge region of the second opening;

the first cover includes a main body;

the wall extends higher than the main body in an axial direction of the crank shaft; and an inner surface of the second cover faces a portion of the fins without any intervening members.

4. An engine comprising:

a crankcase;

a cylinder in the crankcase and including fins on an outer circumference thereof;

a crank shaft inside the crankcase and penetrating the crankcase;

a cooling fan on an outer side of the crankcase and coaxial with the crank shaft to introduce cooling air from the outer side of the crankcase;

a first cover that covers an outer side of the cylinder, the outer side of the crankcase, and the cooling fan; and a second cover capable of being attached to and detached from the first cover; wherein the first cover includes a first opening facing the cooling fan and a second opening facing the fins;

the second cover includes an air inlet facing the first opening and is attached to the first cover to cover the first opening and the second opening;

the first cover further includes a wall between the first opening and the second opening;

the second cover is attached to the first cover to define an outlet for the cooling air adjacent to the wall between the first cover and the second cover;

the first cover includes a main body;

the wall extends higher than the main body in an axial direction of the crank shaft; and an inner surface of the second cover faces a portion of the fins without any intervening members.

* * * * *